US005551677A

United States Patent [19]

Puettmer et al.

[11] Patent Number: 5,551,677

[45] Date of Patent: Sep. 3, 1996

[54] PROFILED CLAMPING JAW FOR CLAMPING WORKPIECES

[75] Inventors: Hermann Puettmer, Kirchberg/Murr; Peter Abraham, Ilsfeld, both of Germany

[73] Assignee: Goetz GmbH Metall- und Anlagenbau, Fellbach, Germany

[21] Appl. No.: 256,820

[22] PCT Filed: Nov. 23, 1992

[86] PCT No.: PCT/EP92/02687

§ 371 Date: Jul. 25, 1994

§ 102(e) Date: Jul. 25, 1994

[87] PCT Pub. No.: WO93/14907

PCT Pub. Date: Aug. 5, 1993

[30] Foreign Application Priority Data

Jan. 25, 1992 [DE] Germany ..... 42 02 032.8

[51] Int. Cl.[6] ..... B25B 1/24

[52] U.S. Cl. ..... 269/266

[58] Field of Search ..... 269/266, 20, 32, 269/90, 224, 275

[56] References Cited

U.S. PATENT DOCUMENTS

| | | | |
|---|---|---|---|
| 2,399,824 | 5/1946 | Pressman | 269/266 |
| 3,211,445 | 10/1965 | Rossman . | |
| 5,407,185 | 4/1995 | Zehnpfennig et al. | 269/266 |

FOREIGN PATENT DOCUMENTS

| | | | |
|---|---|---|---|
| 1037807 | 8/1958 | Germany . | |
| 3627067A1 | 2/1988 | Germany . | |
| 282874A5 | 9/1990 | Germany . | |
| 9204691U1 | 7/1992 | Germany . | |
| 4124340A1 | 1/1993 | Germany . | |
| 4239180A1 | 7/1993 | Germany . | |
| 52-64074 | 5/1977 | Japan | 269/266 |
| 889423 | 12/1981 | U.S.S.R. . | |
| 1146182 | 3/1985 | U.S.S.R. . | |

*Primary Examiner*—Robert C. Watson

*Attorney, Agent, or Firm*—Flynn, Thiel, Boutell & Tanis, P.C.

[57] ABSTRACT

A profiled clamping jaw for a clamping device has a base body (12) and a clamping surface (14) arranged on the base body and adaptable to the surface profile of a workpiece (54). To make it possible to adapt by simple means the clamping surface (14) of the profiled clamping jaw (10) to the surface profile of the workpiece, the claiming surface (14) is composed of a plurality of pressure pieces (16) movable with respect to the base body (12) and capable of being locked thereon in a determined clamping position.

13 Claims, 5 Drawing Sheets

PROFILED CLAMPING JAW FOR CLAMPING WORKPIECES

DESCRIPTION

The invention relates to a profiled clamping jaw for a clamping device comprising a base body and a clamping surface arranged on the base body and adapted to the surface contour of a workpiece, and a process for clamping of workpieces by means of a profiled clamping jaw of the above type.

Clamping jaws are parts of clamping devices, as they, for example, are needed in vises, machine tools or machining centers for holding of workpieces. To clamp profiled rods in particular for the window, door or facade-wall construction, profiled clamping jaws have been used up to now which, in their surface contour, are adapted to the contour of the workpiece to be clamped. Thus, a special profiled clamping jaw is created for each workpiece type, which jaw must be exchanged in the case of a change of the workpiece to be worked in the respective clamping device. The known profiled clamping jaws can therefore because of the long change-over times only be economically utilized in the series production for medium or larger lots of at least 200 pieces, not, however, in the individual or small-series production. This is particularly true for use in large series boring and milling machines, in which a plurality of clamping devices with profiled clamping jaws are being utilized.

Based on this, the basic purpose of the invention is to develop a profiled clamping jaw and a process for clamping of workpieces, with which in a simple manner an adapting to different workpiece contours is possible.

To attain this purpose the characteristic combinations disclosed in claims 1 or 20 are suggested. Further advantageous developments and further embodiments of the invention result from the dependent claims.

The basic principle of the inventive solution is that the clamping surface can be shaped by moving the base body toward the workpiece until reaching a clamping position and can thereby be automatically adapted to the contour of the workpiece surface. This principle can advantageously be realized such that the clamping surface is composed of a plurality of pressure pieces which are movable relative to the base body independently from one another and can be locked on same in a clamping position. The pressure pieces are thereby advantageously movable back and forth in clamping direction of the profiled clamping jaw on the base body and can be locked together on the base body.

An advantageous development of the invention provides that the pressure pieces are movable against the force of a spring in direction of the base body so that they can be moved against the spring force in direction of the base body during movement of the base body toward the workpiece to be clamped under the action of the workpiece surface and can be locked in the clamping position.

A further advantageous development of the invention provides that each pressure piece is guided with a clamping ram in a sliding guide of the base body. The path of movement of the clamping ram is defined in clamping direction advantageously by a front end stop defining the initial position of the pressure pieces and can be locked in every position by means of a blocking member on the base body. The blocking members of the clamping rams can thereby be operated advantageously together mechanically, pneumatically or hydraulically. To operate the blocking members, switching members are advantageously provided which, during movement of the clamping rams, can be advantageously released in the vicinity of their rearward end position.

The blocking members are constructed, for example, as a forming or expanding element which can be operated through a pressure piston movable relative to the clamping ram and can be clamped between the clamping ram and a cylinder wall of the base body, and are thereby in particular constructed as a clamping sleeve, an annular clamping disk or annular forming spring. It is basically also possible to design the blocking members as a clamping block arranged between the base body and clamping ram.

In order to avoid damage to the workpiece surface, the pressure pieces can consist of an elastomer material or can have a coating of an elastomer material. A further improvement in this respect can be achieved such that the pressure pieces are coated on the front side with a closed diaphragm of a rubber-elastic material, which diaphragm forms the clamping surface. Thus, a closed clamping surface is obtained with which a contamination of the space between the pressure pieces can be avoided.

A further preferred development of the invention provides that the clamping rams each carry a ram piston engaging a ram cylinder of the base body, and that the ram cylinders can be loaded with hydraulic fluid in clamping direction through a common hydraulic distributor. The ram pistons are thereby loaded with atmospheric pressure from the surrounding air on their piston surface opposite the hydraulic distributor. Each ram piston can be loaded with the hydraulic fluid through a hydraulically operable check valve arranged between the hydraulic distributor and the associated ram cylinder. The check valves having the function of the blocking member have for this purpose advantageously a control piston arranged in a control cylinder and loadable on two sides with hydraulic fluid. The one piston surface of the control pistons, which surface is advantageously on the side of the check valve, and the ram pistons are thereby advantageously loaded with hydraulic fluid from the same hydraulic distributor.

According to a preferred development of the invention, the associated ram cylinders and the control cylinders are aligned coaxially with one another so that the check valves are operated through their control pistons axially with respect to the ram cylinders.

A further preferred development provides that the hydro-cylinders are arranged in a common cylinder block, whereas the check valves are arranged in a common valve plate which is connected, preferably screwed, to the common cylinder block. The control cylinders can in turn be arranged in a common cylinder plate, which is connected, preferably screwed, to the valve plate, and which is closed by a base plate on the side opposite the valve plate. In this manner it is possible with simple structural means to construct the hydraulic distributor through a free space arranged between the valve plate and the cylinder plate, whereas between the valve plate and the base plate there can be provided in addition a second hydraulic distributor as a free space, which second hydraulic distributor communicates with the control cylinder. A cover plate closing off the cylinder block and having openings forming the sliding guide for penetration by the clamping rams can be provided on the side opposite the base plate, with a free space being able to be saved between the cover plate and the cylinder block, which free space is connected to the ram cylinders and preferably communicates with the atmosphere.

The profiled clamping jaws of the invention are with a particular advantage inserted into the clamping devices which have a block carriage movable on a machine frame in clamping direction toward a block stop adjustable preferably through a center control in accordance with the size of a workpiece to be clamped, and a shaping and clamping carriage movable in clamping direction on the block carriage and carrying the profiled clamping jaw. The profiled clamping jaw of the invention can basically also be used in a common vise. The base body of the profiled clamping jaw must in this case be merely fastened on the clamping jaw of the vise.

Workpieces can be clamped with the profiled clamping jaw of the invention in such a manner that first the base body is moved toward the workpiece and the clamping surface is thereby shaped with an automatic adaptation to the contour of the workpiece surface, and that the clamping surface after reaching a clamping position relative to the base body is set nonshapably and is pressed with the workpiece being clamped with a pregiven holding force against its surface. Thus, it is achieved that workpieces with essentially any desired, also complicated surface contours, can be gripped force-lockingly and form-lockingly at a fully automatic handling with an automatic tolerance balance with a large-surface bearing.

The invention will be discussed in greater detail hereinafter in connection with the exemplary embodiments schematically illustrated in the drawings, in which.

Figure 2:
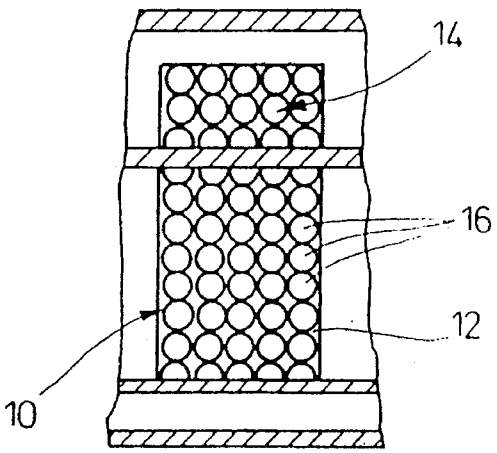
FIG. 2 is a cross-sectional view taken along the section line 2—2 of FIG. 1.

The profiled clamping jaws 10 illustrated in the drawings consist essentially of a base body 12 and a clamping surface 14 composed of a plurality of pressure pieces of an elastomer material, which pressure pieces are movable independently from one another relative to the base body 12 along a lifting path h. The pressure pieces 16 are each arranged on one end of a clamping ram 18 which is movably supported in lifting direction in a sliding guide 20 of the base body 12.

Figure 5:
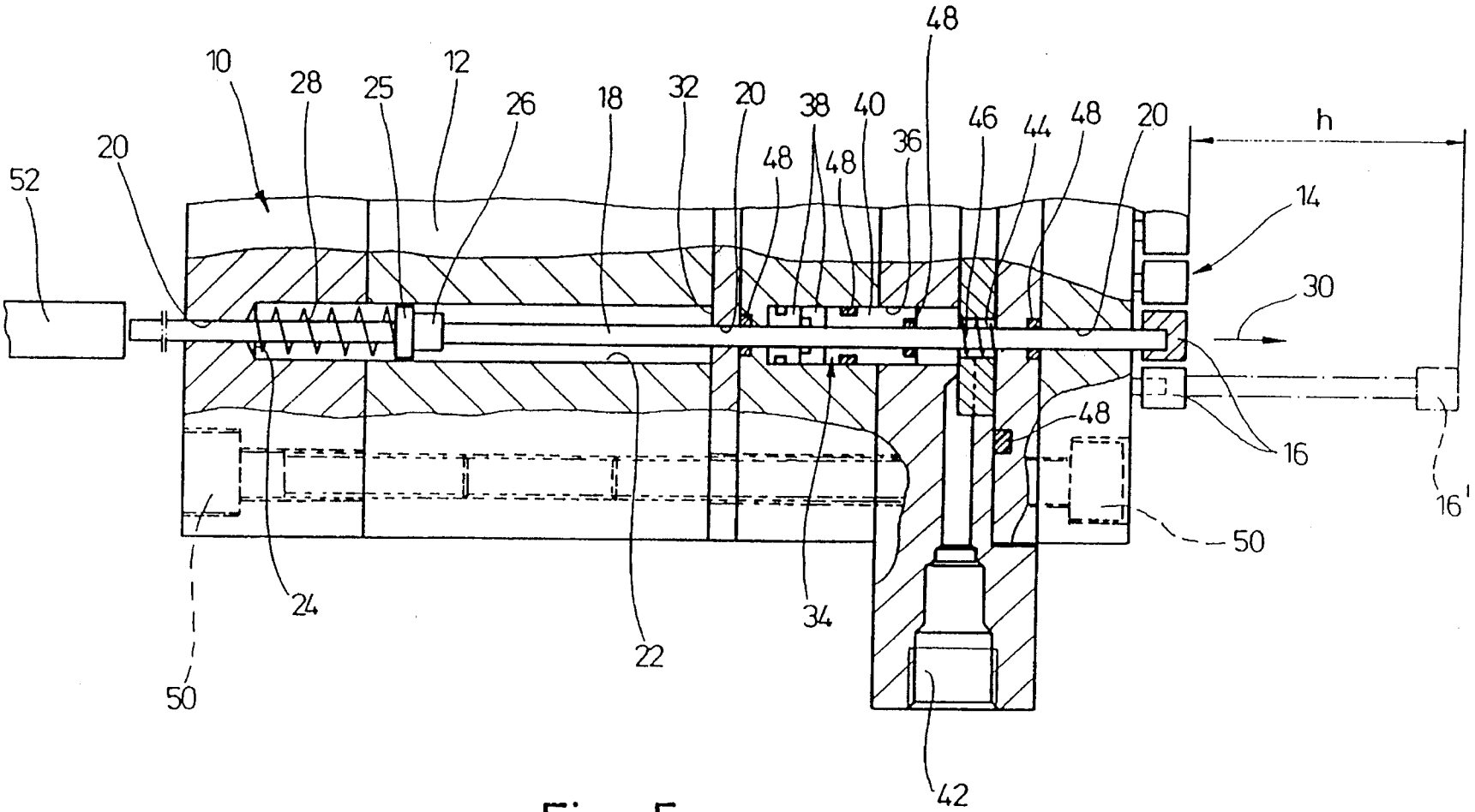
FIG. 5 is a longitudinal cross-sectional view of a profiled clamping jaw in an enlarged illustration compared with FIGS. 1 to 4.

In the case of FIG. 5, the clamping rams 18 each extend within the base body 12 through a cylindrical recess 22 and are there loaded by a pressure spring 28 with a force directed in the direction of the arrow 30, which pressure spring 28 is clamped between the cylinder base 24 and an adjusting ring 26 fastened on the clamping ram 18 and having a flange 25. The pressure pieces 16 thus assume in their clamped-in rest position the initial position 16' shown by dash-dotted lines in FIG. 5, in which position 16' the clamping ram 18 rests with its adjusting ring 26 under the action of the pressure spring 28 against the end stop 32. The clamping rams 18 extend within the base body 12 furthermore through a blocking member 34 which, in the exemplary embodiment illustrated in FIG. 5, includes a cylinder chamber 36 arranged in the base body 16 and through which extends the clamping ram 18, and two forming elements 38 arranged in the cylinder chamber 36 and are designed, for example, as annular clamping disks or annular forming springs, and an annular piston 40 surrounding the clamping ram 18. The forming elements 38 of the blocking member 34 can be moved, in every position of the clamping ram 18, into their blocking position supported both on the inside wall of the cylinder chamber 36 and also on the ram surface and when the annular piston 40 is located with pressurized hydraulic or pneumatic media through the connecting piece 42 and the bottom side of the annular chamber 44. The piece 42 is connected to the annular chambers 44 of all blocking members 34 so that the blocking of all clamping rams 18 within the base body 12 occurs at the same time. An auxiliary spring 46 arranged within the annular chamber 44 takes care that the two-part annular piston 40 is, even in the relaxed state, always in a defined initial position, whereas the sealing rings 48 seal off the base body against overflowing and escaping pressurized fluid. The blocking members are operated by switching members 52 which can be released in their rearward end position through the clamping rams 18.

FIG. 5 shows that the base body 12 is composed of several disk-shaped structural parts which are connected through several clamping-screw pairs 50 distributed over the circumference.

Figure 8:
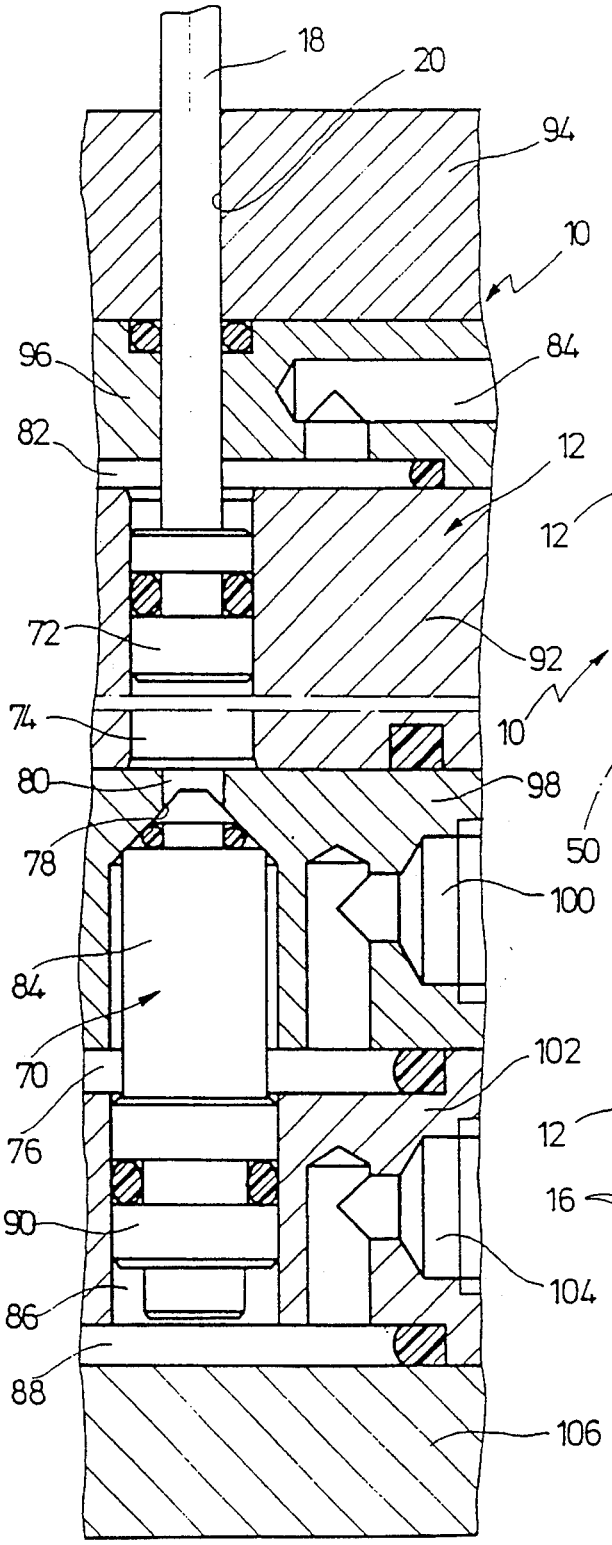
FIG. 8 shows a section of FIG. 7 in an enlarged illustration.
Figure 7:
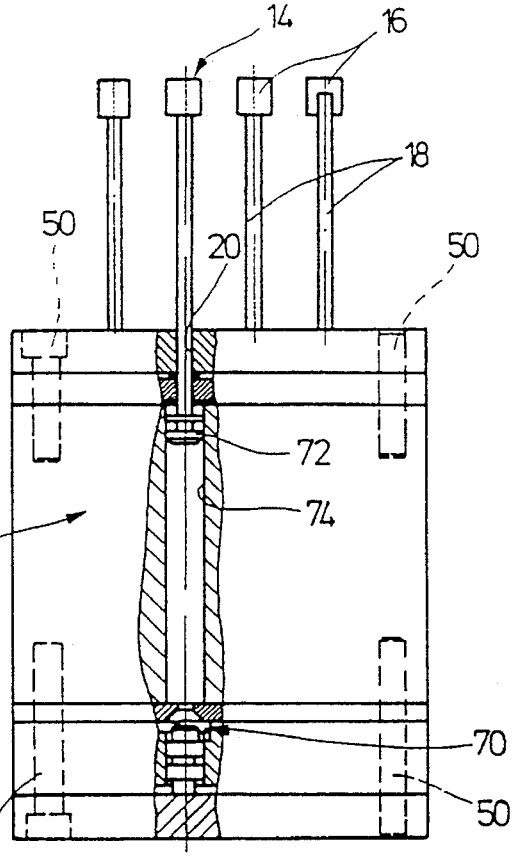
FIG. 7 is a partially cross-sectional side view of the profiled clamping jaw according to FIG. 6.
Figure 6:
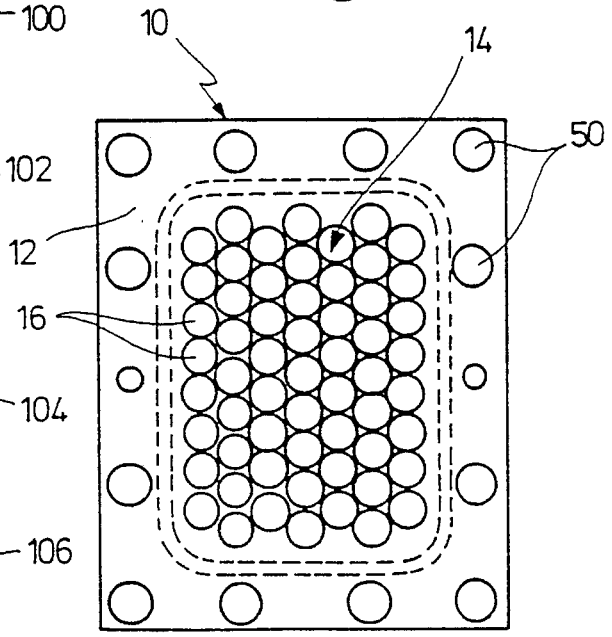
FIG. 6 is a top view of a profiled clamping jaw with hydraulically operable clamping rams.

The clamping rams 18 of the profiled clamping jaws shown in FIGS. 6 to 8 are moved with their pressure pieces 16 hydraulically into their initial position shown in FIG. 7 and are locked in their clamping position with a hydraulically operable check valve 70. The rams 18 engage for this purpose with a ram piston 72 arranged at their rearward end in a ram cylinder 74 within the base body 12, which cylinder 74 can be loaded at the bottom side through a hydraulic distributor 76 and the valve opening 80 defined by the conical seat 78 of the check valve 70, with hydraulic fluid. The ram cylinders 74 communicate at their rod-side end through a distributor chamber 82 and the opening 84 with the surrounding air. The valve needle 84 of the check valve 70 is operated through a control piston 90 guided in a control cylinder 86 and is loadable on both sides with hydraulic fluid out of the distributor chambers 76 and 88. As can particularly be seen in FIG. 8, the base body 12 is also in this case composed of several blocklike or disklike structural parts which are connected by several circumferentially arranged clamping screws 50. The clamping cylinders 74 are thereby provided in a common cylinder block 92, which is closed off on the side of the rods by a cover plate 94 containing the sliding guides 20 for the rams 18 and an intermediate plate 96 containing the connection 84 and the distributor chamber 82. A distributor plate 98 with the valve seats 78, the valve openings 80 and a hydraulic connection 100 leading to the distributor chamber 74 is provided on the bottom broad side surface of the cylinder block 92. A cylinder plate 102 with the control cylinders 86 is provided on the side of the valve plate 98, which side is opposite the cylinder block, for receiving the control pistons 90 which are additionally provided with front-side recesses for forming the hydraulic distributors 76, 88 and a connection 104 leading to the hydraulic distributor 88. The plate 102 is closed off on the outside by a base plate 106.

The hydraulic profiled clamping jaw according to FIGS. 6 to 8 operates as follows: In order to drive the clamping ram 18 out into its initial position shown in FIG. 7, the distributor chamber 76 is loaded with pressurized oil through the connection 100, while the distributor chamber 88 is connected to the tank. The control pistons 90 are in this manner moved with the valve needles 84 from their blocking position shown in FIG. 8 into the open position according to FIG. 7. Pressurized oil moves in this position out of the distributor chamber 76 into the ram cylinders 74 and drives the ram 18 into its initial position shown in FIG. 7. The profiled clamping jaw 10 is during a clamping operation moved with its pressure pieces 16 against a surface to be clamped, with the distributor chamber 76, when the valves 70 are open, being open toward the tank or toward an elastic pressure storage such that hydraulic fluid can be removed from the clamping cylinders 74. After reaching the clamping position, the distributor chamber 88 is loaded with pressure oil through the connection 104 and the valves 70 are thus moved into their blocking position. In order to avoid leakage out of the clamping cylinders, it is also possible to maintain a certain hydraulic pressure in the distributor chamber 76.

Figure 1:
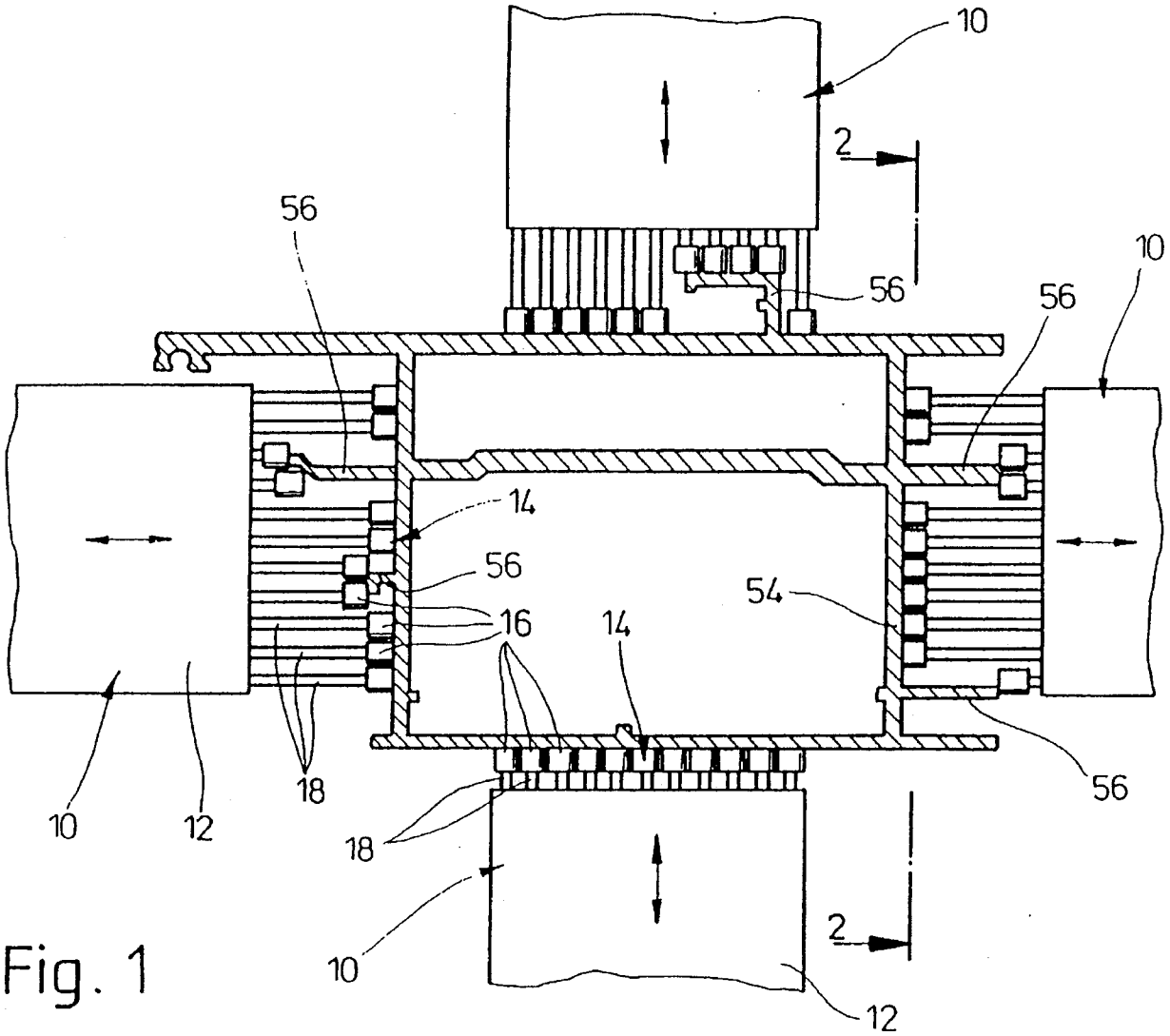
FIG. 1 shows a section out of a clamping device with four crosswise arranged profiled clamping jaws.

In the exemplary embodiment of a clamping device, sections of which are in FIGS. 1 and 2, there exist four profiled clamping jaws 10, between the clamping surfaces 14 of which is clamped a workpiece 54 with a complicated surface contour, which workpiece is designed as a profiled rail. The clamping surface 14 is adapted to the surface contour such that the base bodies 12 are moved initially with nonclamped clamping rams 18 toward the respective surface part until they strike the pressure pieces 16 which are in their initial position. The nonclamped clamping rams 18 are then during the course of a further movement moved under the action of the workpiece surface against the force of the pressure springs 28 into the base body until the clamping ram, which has been moved the farthest, releases through the associated shifting member 52 the blocking of the clamping ram 18 within the base body 12 in the above-described manner. By suitably adapting the lift h to the dimensions of the projecting parts 56 of the workpiece, all pressure pieces 16 rest in this case correctly with respect to the contour on the workpiece surface so that the holding forces engaging the workpiece are distributed over the entire clamping surface 14 of the profiled clamping jaws. The clamping of the workpieces between the profiled clamping jaws including the adapting of the claiming surface 14 to the surface contour can occur fully automatically in suitable clamping devices.

Figure 3:
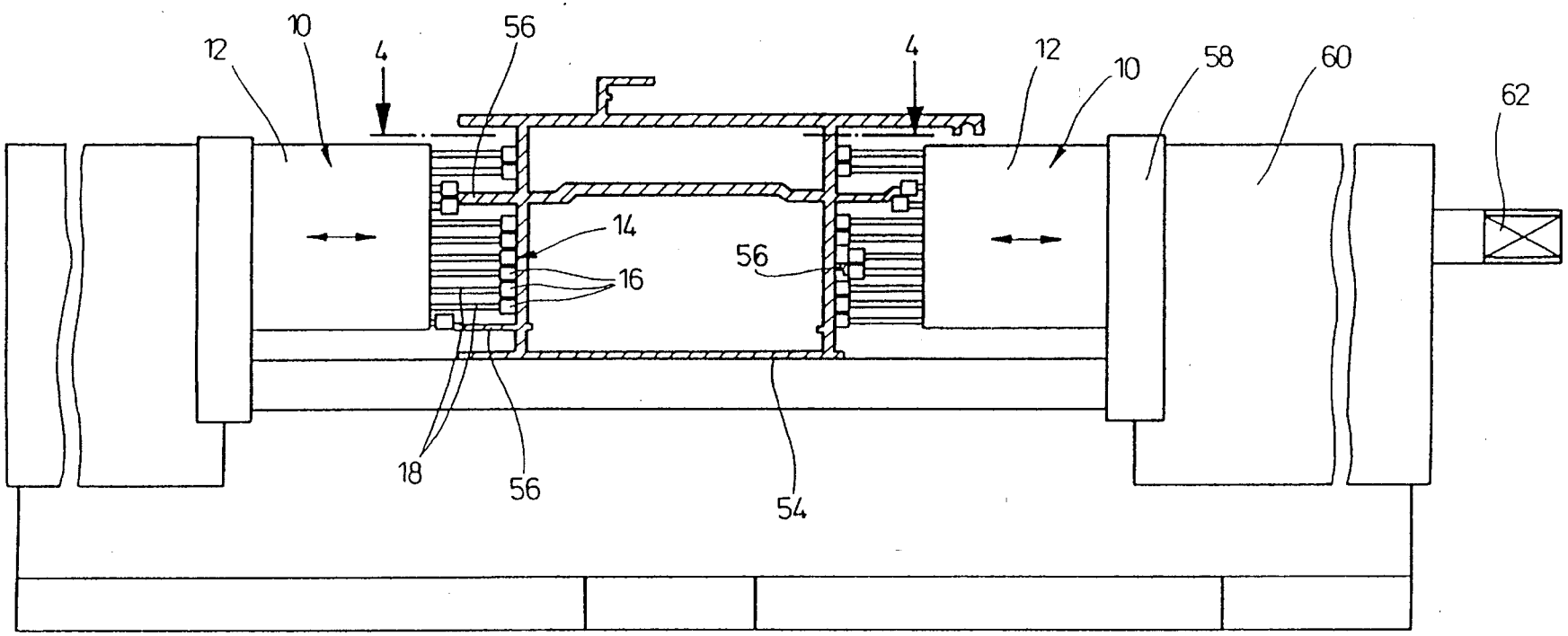
FIG. 3 is a side view of a vise having profiled clamping jaws.
Figure 4:
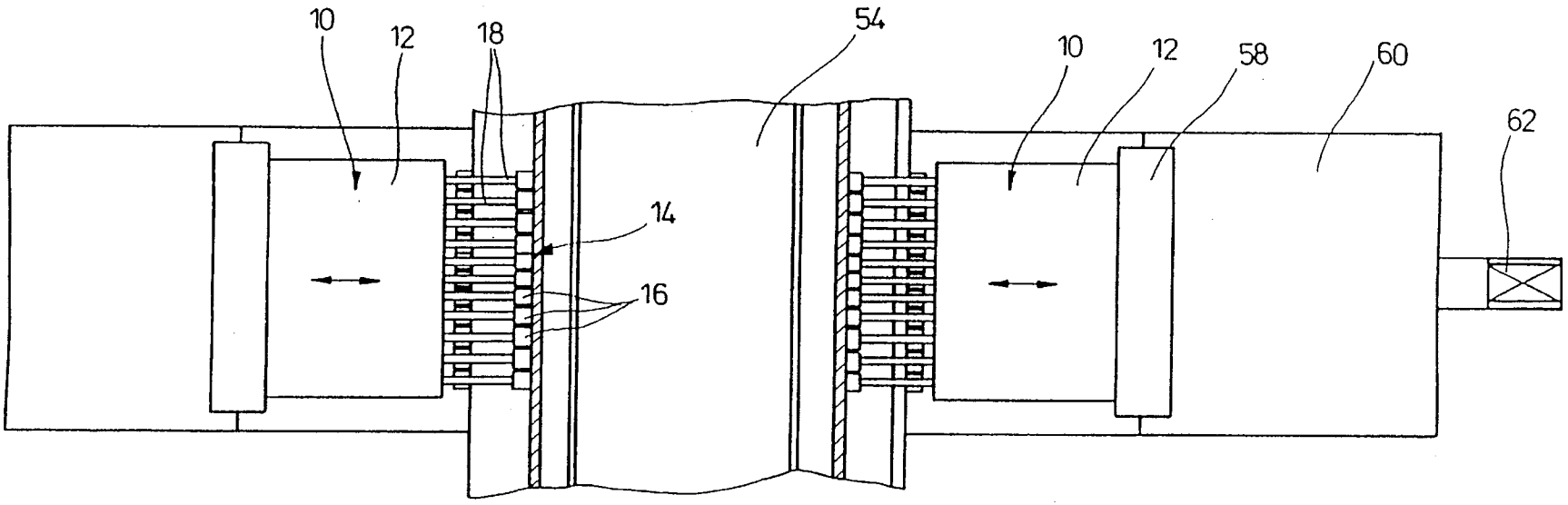
FIG. 4 is a top view of the vise according to FIG. 3.

It is possible as this can be seen in FIGS. 3 and 4 to arrange the described profiled clamping jaws also on a manually operated vise 60. The base bodies 12 of the profiled clamping jaws 10 must for this purpose be merely fastened, preferably screwed to the clamping jaw 58 of the vise 60. The workpiece 54 is then clamped with an adaptation to the workpiece surface in the above-described manner with the one difference that the vise 60 with the profiled clamping jaw 10 through the crankpin 62 and the blocking of the clamping ram 18 after adaptation of the clamping surface 14 to the surface contour is each done manually.

In summary the following is to be stated: The invention relates to a profiled clamping jaw for a clamping device with a base body 12 and a clamping surface 14 arranged on the base body and adaptable to the surface contour of a workpiece 54. In order to enable with simple means an adaptation of the clamping surface 14 of the profiled clamping jaw 10 to the surface contour of the workpiece 54, the clamping surface 14 is composed of a plurality of pressure pieces which are movable relative to the base body 12 and which can be locked in a clamping position on said base body.

We claim:

1. In a profiled clamping jaw for a clamping device comprising a base body and a shapable clamping surface arranged on said base body, said clamping surface being shapable by moving said base body toward a workpiece until a clamping position is reached, and thereby automatically adapting to the contour of the workpiece surface, said clamping surface being composed of a plurality of pressure pieces each movable independently of one another relative to said base body and being lockable in said clamping position on said base body, each said pressure piece being guided by a clamping ram in a sliding guide of said base body, said clamping rams each carrying a ram piston in a ram cylinder of said base body, and said ram cylinders being loadable through a common hydraulic distributor in said clamping direction with hydraulic fluid, the improvement wherein between individual said ram cylinders and said hydraulic distributor there is arranged a check valve, wherein said check valves each carry a single control piston having a plurality of piston surfaces loadable on two sides with hydraulic fluid and arranged in a control cylinder, of said base body and wherein said control pistons are loadable together with hydraulic fluid on their piston surfaces, which are opposite to one another, through two separate hydraulic distributors.

2. The profiled clamping jaw according to claim 1, wherein said ram pistons are loaded with atmospheric pressure at their piston surface opposite said hydraulic distributor.

3. The profiled clamping jaw according to claim 1, wherein said ram pistons and said piston surfaces of said control pistons are loadable with hydraulic fluid from a same hydraulic distributor.

4. The profiled clamping jaw according to claim 1, wherein said ram cylinders and said control cylinders, which are associated with one another, are aligned axially parallel.

5. In a profiled clamping jaw for a clamping device comprising a base body and a shapable clamping surface arranged on said base body, said clamping surface being shapable by moving said base body toward a workpiece until a clamping position is reached and thereby automatically adapting to the contour of the workpiece surface, said clamping surface being composed of a plurality of pressure pieces each movable independently of one another relative to said base body and being lockable in said clamping position on said base body, each said pressure piece being guided by a clamping ram in a sliding guide of said base body, said clamping rams each carrying a ram piston in a ram cylinder of said base body, and said ram cylinders being loadable with hydraulic fluid in said clamping direction through a common hydraulic distributor, the improvement wherein between each of the individual said ram cylinders and said hydraulic distributor there is arranged a check valve, wherein said check valves each carry a single control piston having a plurality of piston surfaces arranged in a control cylinder and loadable with hydraulic fluid on two sides, and wherein said ram pistons and said piston surfaces of said control pistons, which said piston surfaces are on the side of said check valve, are loadable with hydraulic fluid from a same said hydraulic distributor.

6. The profiled clamping jaw according to claim 5, wherein said ram cylinders and said control cylinders, which are associated with one another, are aligned axially parallel.

7. The profiled clamping jaw according to claim 6, wherein said ram cylinders are arranged in a common cylinder block.

8. The profiled clamping jaw according to claim 7, wherein said check valves are arranged in a common valve plate, which is connected to said cylinder block.

9. The profiled clamping jaw according to claim 8, wherein said control cylinders are arranged in a single common cylinder plate connected to said valve plate, and said control cylinders are closed off on a side opposite said valve plate by a base plate.

10. The profiled clamping jaw according to claim 9, wherein between said valve plate and said cylinder plate there is arranged a free space forming said hydraulic distributor.

11. The profiled clamping jaw according to claim 8, including a free space arranged between said valve plate and a base plate forming a second hydraulic distributor communicating with said control cylinders.

12. The profiled clamping jaw according to claim 5, including a cover plate closing off a cylinder block on a side of said pressure piece and having a plurality of openings for passage of said clamping rams.

13. The profiled clamping jaw according to claim 11, wherein between said base plate and said cylinder block there is arranged a space connected to said ram cylinders on a side of a rod portion of said ram piston and communicating with the atmosphere.

* * * * *